US012729854B2

(12) United States Patent
Shi et al.

(10) Patent No.: US 12,729,854 B2
(45) Date of Patent: Sep. 8, 2026

(54) ZERO-POWER-CONSUMPTION SELF-ADAPTIVE DISTRIBUTED WASTE HEAT RECOVERY AND UTILIZATION SYSTEM FOR ETHYLENE DEVICE

(71) Applicant: BEIJING AEROSPACE ENERGY CONSERVATION AND ENVIRONMENTAL PROTECTION TECHNOLO, Beijing (CN)

(72) Inventors: Mingwei Shi, Beijing (CN); Songlin Shao, Beijing (CN); Yue Liu, Beijing (CN); Xiaofeng Song, Beijing (CN); Weibin Wang, Beijing (CN)

(73) Assignee: BEIJING AEROSPACE ENERGY CONSERVATION AND ENVIRONMENTAL PROTECTION TECHNOLOGY CO., LTD, Beijing (CN)

( * ) Notice: Subject to any disclaimer, the term of this patent is extended or adjusted under 35 U.S.C. 154(b) by 379 days.

(21) Appl. No.: 18/559,572

(22) PCT Filed: Jul. 12, 2022

(86) PCT No.: PCT/CN2022/105099
§ 371 (c)(1),
(2) Date: Nov. 8, 2023

(87) PCT Pub. No.: WO2023/221274
PCT Pub. Date: Nov. 23, 2023

(65) Prior Publication Data

US 2025/0093028 A1 Mar. 20, 2025

(30) Foreign Application Priority Data

May 18, 2022 (CN) ..... 202210550861.1

(51) Int. Cl.
*F23L 15/04* (2006.01)
*F28F 27/02* (2006.01)
*F28G 1/16* (2006.01)

(52) U.S. Cl.
CPC ..... *F23L 15/045* (2013.01); *F28F 27/02* (2013.01); *F28G 1/16* (2013.01)

(58) Field of Classification Search
CPC ..... F23L 15/045; F28F 27/02; F28F 1/16
USPC ..... 431/11
See application file for complete search history.

(56) References Cited

U.S. PATENT DOCUMENTS 5,820,362 A * 10/1998 Broach ..... F23L 15/045 432/209
5,876,197 A * 3/1999 Engelberg ..... F27B 3/263 432/24

FOREIGN PATENT DOCUMENTS

CN 2622558 Y 6/2004
CN 1621745 A 6/2005
(Continued)

OTHER PUBLICATIONS

The Russian 1st Official Action issued on Mar. 6, 2024 for RU2023128494.

(Continued)

*Primary Examiner* — Avinash A Savani
(74) *Attorney, Agent, or Firm* — Yue (Robert) Xu; Apex Attorneys at Law, LLP

(57) ABSTRACT

A zero-power-consumption self-adaptive distributed waste heat recovery and utilization system for an ethylene device is provided. The waste heat recovery and utilization system includes a waste heat collection pipeline system, multiple waste heat recovery devices arranged in groups, and a waste heat return pipeline system. The waste heat collection pipeline system is configured to lead out a working medium (Continued)

having waste heat from a waste heat source of the ethylene device and distribute the working medium to the waste heat recovery devices. The waste heat recovery devices are configured to heat combustion-supporting air of a bottom burner of an ethylene cracking furnace through the waste heat. The waste heat return pipeline system is configured to transport the working medium that has undergone waste heat recovery and utilization back to the waste heat source.

11 Claims, 2 Drawing Sheets

(56) References Cited

FOREIGN PATENT DOCUMENTS

| | | | |
|---|---|---|---|
| CN | 102393024 | A | 3/2012 |
| CN | 102502512 | A | 6/2012 |
| CN | 104089294 | A | 10/2014 |
| CN | 106051805 | A | 10/2016 |
| CN | 106196145 | A | 12/2016 |
| CN | 207776908 | U | 8/2018 |
| CN | 108518669 | A | 9/2018 |
| CN | 216047807 | U | 3/2022 |
| JP | 2004292889 | A | 10/2004 |
| JP | 2020003090 | A | 1/2020 |
| RU | 2145036 | C1 | 1/2000 |
| RU | 2147707 | C1 | 4/2000 |
| SU | 646141 | A1 | 2/1979 |

OTHER PUBLICATIONS

International Search Report for PCT/CN2022/105099 mailed Dec. 19, 2022, ISA/CN.

CNIPA First Office Action corresponding to Application No. 202210550861.1; Issued date of Jan. 19, 2023.

* cited by examiner

ZERO-POWER-CONSUMPTION SELF-ADAPTIVE DISTRIBUTED WASTE HEAT RECOVERY AND UTILIZATION SYSTEM FOR ETHYLENE DEVICE

The present application is a national phase application of PCT international patent application PCT/CN2022/105099, filed on Jul. 12, 2022, which claims priority to Chinese Patent Application No. 202210550861.1, titled "ZERO-POWER SELF-ADAPTIVE DISTRIBUTED WASTE HEAT RECOVERY AND UTILIZATION SYSTEM OF ETHYLENE PLANT", filed on May 18, 2022 with the China National Intellectual Property Administration, both of which are incorporated herein by reference in their entireties.

FIELD

The present application relates to the field of ethylene-device waste heat recovery technology, and in particular to a zero-power-consumption self-adaptive distributed waste heat recovery and utilization system for an ethylene device.

BACKGROUND

An ethylene device area usually has abundant low-temperature waste heat resources, such as circulating quenched water, various condensates, exhausted steam, and process hot water. Some of the low-temperature waste heat resources are directly discharged, and some require to be treated with secondary energy consumption before recovery. In an ethylene cracking furnace, multiple burner nozzles are distributed in a same furnace chamber, and the furnace chamber is in a slightly negative pressure environment, to which the conventional centralized air preheating method is difficult to apply. The ethylene cracking furnace usually uses air at a normal temperature for combustion supporting, and the temperature of air is low, which is not conducive to the improvement of the overall thermal efficiency of the ethylene cracking furnace. Air may be used a heat exchange carrier to recover and utilize the low-temperature waste heat in the device area. The ethylene cracking furnace has very high requirements on the temperature field in the furnace chamber, and combustion conditions of burners in the furnace chamber should be substantially identical to ensure the uniformity of the temperature field in the furnace chamber.

At present, for a system that uses combustion-supporting air of a bottom burner of the ethylene cracking furnace as a carrier to recover and utilize the low-temperature waste heat, ensuring the uniformity of the temperature field in the furnace chamber of the ethylene cracking furnace has not been considered. An addition of a waste heat recovery device changes the operating environment of the furnace chamber and has a negative impact on the temperature field in the furnace chamber. In addition, power equipment such as a blower and a water pump, and electronic instruments such as a control valve are added, improving the complexity of the system and increasing power consumption and costs of the system.

SUMMARY

The technical problem to be solved by the present application is to provide a zero-power-consumption self-adaptive distributed waste heat recovery and utilization system for an ethylene device, which can be self-adaptively adjusted, and uniformity of flow rates in groups of waste heat recovery devices can be realized without an adjustment control valve, thereby ensuring the uniformity of the temperature field in a furnace chamber of an ethylene cracking furnace.

In addition, waste heat of a group of ethylene cracking furnaces can be comprehensively recovered, avoiding problems such as water hammer in a pipe network of the system due to pressure fluctuations, solving the problem of ash accumulation in the waste heat recovery device, and improving heat exchange efficiency.

Technical solutions of the present application are as follows.

A zero-power-consumption self-adaptive distributed waste heat recovery and utilization system for an ethylene device includes a waste heat collection pipeline system, multiple waste heat recovery devices arranged in groups and a waste heat return pipeline system. The waste heat collection pipeline system is configured to lead out a working medium having waste heat from a waste heat source of the ethylene device and distribute the working medium to the multiple waste heat recovery devices. The multiple waste heat recovery devices are configured to heat combustion-supporting air of a bottom burner of an ethylene cracking furnace through the waste heat, and the waste heat return pipeline system is configured to transport the working medium that has undergone waste heat recovery and utilization back to the waste heat source. The waste heat collection pipeline system is provided with flow control elements in stages, and flow rates in pipelines are distributed differentially through the flow control elements to allow flow rates in the groups of waste heat recovery devices to be distributed evenly.

In an embodiment, the multiple waste heat recovery devices are arranged in groups, each of the groups includes at least two waste heat recovery devices, and the multiple waste heat recovery devices are connected in parallel and operate independently.

The waste heat collection pipeline system includes a collection master pipe, collection main pipes, and collection branch pipes.

The waste heat return pipeline system includes a return master pipe, return main pipes, and return branch pipes.

The collection master pipe is configured to lead out the working medium having waste heat from the waste heat source, the working medium is transported to the groups of waste heat recovery devices through the collection main pipes, and is further transported to each of the waste heat recovery devices in a group through corresponding ones of the collection branch pipes.

The working medium that has undergone waste heat recovery and utilization by each of the waste heat recovery devices in the group is returned, through corresponding ones of the return branch pipes, to a corresponding one of the return main pipes corresponding to the waste heat recovery devices in the group, and further returned to the waste heat source through the return master pipe.

The collection master pipe is provided with a master pipe flow control element, each of the collection main pipes is provided with a main pipe flow control element, and each of the collection branch pipes is provided with a branch pipe flow control element.

In an embodiment, the flow rates in the groups of waste heat recovery devices are evenly distributed, and pressure drops of the waste heat recovery and utilization system satisfy the following conditions:

$$\begin{cases} \frac{\Delta P_a}{\Delta P_t} \in [0.01, 0.1] \\ \frac{\Delta P_b}{\Delta P_t} \in [0.01, 0.1] \\ \frac{\Delta P_c}{\Delta P_t} \in [0.8, 0.98] \\ \Delta P_a + \Delta P_b + \Delta P_c = \Delta P_t \end{cases}$$

$$\Delta P_{g1} + \Delta P_{j1} + \Delta P_{z1} = \Delta P_{g2} + \Delta P_{j2} + \Delta P_{z2} = \ldots = \Delta P_{gn} + \Delta P_{jn} + \Delta P_{zn}$$

where $\Delta P_t$ represents a total pressure drop of the waste heat recovery system, $\Delta P_a$ represents a total pressure drop of the collection master pipe, the return master pipe and the master pipe flow control element, $\Delta P_b$ represents a total pressure drop of the collection main pipes, the return main pipes and the main pipe flow control elements, and $\Delta P_c$ represents a total pressure drop of the waste heat recovery devices, the collection branch pipes, the return branch pipes and the branch pipe flow control elements; and n represents the number of the groups of waste heat recovery devices, $\Delta P_{gi}$ represents a total pressure drop of a corresponding one of the collection main pipes and a corresponding one of the return main pipes corresponding to the waste heat recovery devices in group i, $\Delta P_{ji}$ represents a total pressure drop of the waste heat recovery devices in group i and corresponding ones of the branch pipe flow control elements corresponding to the waste heat recovery devices in group i, and $\Delta P_{zi}$ represents a total pressure drop of corresponding ones of the collection branch pipes and corresponding ones of the return branch pipes corresponding to the waste heat recovery devices in group i, where i=1, 2, 3, . . . , n.

In an embodiment, operating parameters of the master pipe flow control element, the main pipe flow control elements, or the branch pipe flow control elements conform to the following relationship:

$$q = \mu A \sqrt{2\Delta P \rho}$$

where q represents the flow rate, μ represents the flow coefficient, A represents the area of a flow control element, ΔP represents the pressure loss, and ρ represents the density of the waste heat source.

In an embodiment, the number of the waste heat recovery devices in each of the groups is 8 to 10.

In an embodiment, the waste heat collection pipeline system is provided with a desuperheating pressure-balance device, and the desuperheating pressure-balance device includes a pressure sensor, a temperature sensor, a regulating valve, desuperheating water, and a desuperheater.

The pressure sensor and temperature sensor are configured to monitor a temperature signal and a pressure signal of the waste heat collection pipeline system, and the regulating valve is configured to perform opening degree adjustment based on the temperature signal and the pressure signal to control a flow rate of the desuperheating water. The desuperheater is configured to spray the desuperheating water to cool the waste heat source and maintain a stable pressure in the waste heat collection pipeline system.

In an embodiment, each of the waste heat recovery devices includes an air inlet, an air outlet, a connection air duct, a water inlet assembly, a water outlet assembly, and a heat exchange element. The water inlet assembly is connected to the waste heat collection pipeline system for introducing the working medium having waste heat, and the water outlet assembly is connected to the waste heat return pipeline system for returning the working medium that has undergone the waste heat recovery and utilization. The air inlet is configured to introduce cold air. The heat exchange element is configured to exchange heat between the working medium having waste heat and the cold air, and the air outlet is connected to the connection air duct for transporting preheated air.

In an embodiment, each of the waste heat recovery devices further includes an online self-cleaning device, which includes a blow pipeline and blow nozzles. Each of the blow nozzles is a fan-shaped atomizing nozzle with a spraying angle ranging from 60 degrees to 120 degrees, and the blow nozzles are arranged opposite to each other in two layers. The blow medium is transported to the blow nozzles through the blow pipeline to clean the waste heat recovery device. The blow medium is compressed air or low-pressure steam.

In an embodiment, the heat exchange element is a circular or elliptical finned tube bundle.

In an embodiment, a spoiler assembly is provided in the finned tube bundle.

The advantages of the present application compared with the conventional technology are as follows.

(1) In the zero-power-consumption self-adaptive distributed waste heat recovery and utilization system for an ethylene device according to the present application, mechanical flow control elements are arranged in the waste heat collection pipeline system, and flow rates in pipelines of the system can be distributed through differential design of the flow control elements. The system is self-adaptable, and the uniformity of the flow distribution of the waste heat recovery devices is realized without adding an adjustment control valve, thereby ensuring the uniformity of the temperature field in a furnace chamber of the ethylene cracking furnace. The temperature deviation between different groups of waste heat recovery devices can be accurately controlled within ±3 celsius degrees.

(2) In the zero-power-consumption self-adaptive distributed waste heat recovery and utilization system for an ethylene device according to the present application, the desuperheating pressure-balance device is arranged in the waste heat collection pipeline system to monitor the pressure fluctuation of the waste heat collection pipeline system in real time, and desuperheating treatment is performed as necessary, to avoid problems such as water hammer in the pipe network of the system caused by the pressure fluctuation, so that the system operates safely and stably.

(3) In the zero-power-consumption self-adaptive distributed waste heat recovery and utilization system for an ethylene device according to the present application, the online self-cleaning device is arranged in each of the waste heat recovery devices, and the online cleaning of the dust accumulated in the device is realized through the operation in combination of multi-stage nozzles, ensuring stable and efficient operation of the device.

(4) In the zero-power-consumption self-adaptive distributed waste heat recovery and utilization system for an ethylene device according to the present application, the heat exchange element of each of the waste heat recovery devices is implemented as the circular or elliptical finned tube, and an efficient spoiler assembly is provided in the finned tube, improving the heat exchange efficiency.

(5) In the zero-power-consumption self-adaptive distributed waste heat recovery and utilization system for an ethylene device according to the present application, the waste heat recovery devices are arranged in groups, connected in parallel, and operate independently. The waste heat recovery devices are connected with the waste heat collection pipeline system and the waste heat return pipeline system to form the distributed waste heat recovery system, which can realize comprehensive recovery of waste heat of a group of ethylene cracking furnaces.

DETAILED DESCRIPTION OF EMBODIMENTS

A zero-power-consumption self-adaptive distributed waste heat recovery and utilization system for an ethylene device is provided according to the present application. Various low-temperature waste heat in an ethylene device area is recovered and reused without increasing additional power consumption, and without adding an adjustment control valve and affecting the normal operation of a cracking furnace. The waste heat recovery and utilization system mainly includes: a waste heat collection pipeline system, multiple waste heat recovery devices and a waste heat return pipeline system. The waste heat collection pipeline system is configured to lead out and collect a working medium having waste heat and distribute the working medium to the multiple waste heat recovery devices. The multiple waste heat recovery devices are configured to use combustion-supporting air of a bottom burner of an ethylene cracking furnace as a heat exchange carrier to utilize the waste heat. The cooled working medium is returned to an original waste heat source system through the waste heat return pipeline system.

The design of flow rate distribution of the system is carried out through the design of pressure drop distribution of the system. Specifically, mechanical flow control elements are arranged in the waste heat collection pipeline system, and the flow control elements are set differentially, so that the flow rate distribution of pipelines of the system meets design requirements.

A heat exchange element with high-efficiency is arranged in each of the waste heat recovery devices. Cold air is introduced under a negative pressure environment of the ethylene cracking furnace to exchange heat with the waste heat source and become hot air, and then the hot air enters the burner for supporting combustion. The waste heat source is recovered and utilized.

Further description is provided below according to the embodiments.

Figure 1:
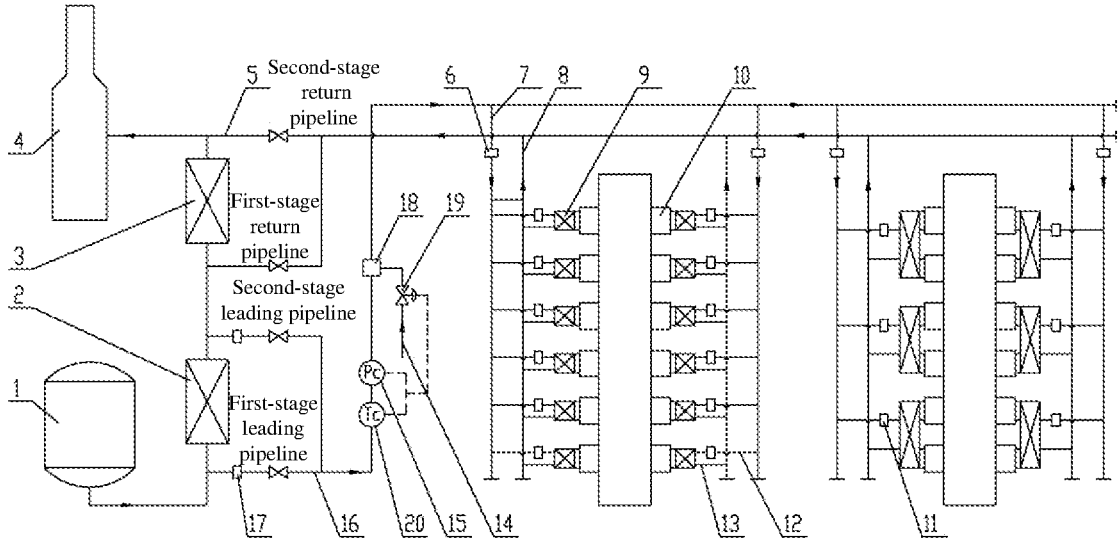
FIG. 1 is a schematic view of a waste heat recovery and utilization system according to the present application.

As shown in FIG. 1, a zero-power-consumption self-adaptive distributed waste heat recovery and utilization system for an ethylene device is provided according to an embodiment. The waste heat recovery and utilization system includes a waste heat collection pipeline system, multiple waste heat recovery devices 9 and a waste heat return pipeline system.

The bottom of each ethylene cracking furnace is provided with multiple bottom burners. Multiple waste heat recovery devices 9 are provided in the embodiment. The waste heat recovery devices 9 are used by one burner or multiple burners at the same time. The waste heat recovery devices 9 are arranged in groups. The multiple waste heat recovery devices 9 are connected in parallel with each other and operate independently, and are connected with the waste heat collection pipeline system and the waste heat return pipeline system, to form the distributed waste heat recovery system.

The waste heat collection pipeline system includes a collection master pipe 16, collection main pipes 7 and collection branch pipes 12. The waste heat return pipeline system includes a return master pipe 5, return main pipes 8 and return branch pipes 13. The collection master pipe 16 is configured to lead out the working medium having waste heat from the waste heat source. The collection main pipes 7 are connected to the collection master pipe 16 to transport the working medium having waste heat to the groups of waste heat recovery devices 9. The collection branch pipes 12 are connected to the collection main pipes 7 to transport the working medium having waste heat to each of the waste heat recovery devices 9 in the groups. The waste heat return pipeline system includes a return master pipe 5, return main pipes 8, and return branch pipes 13. The return branch pipes 13 are connected to the return main pipes 8, and the waste heat recovered by each of the waste heat recovery devices 9 is transported to a corresponding one of the return main pipes 8. The return main pipes 8 are connected to the return master pipe 5, and the return master pipe 5 is configured to transport the working medium that has undergone waste heat recovery and utilization back to the waste heat source system. The collection master pipe 16 is provided with a master pipe flow control element 17, each of the collection main pipes 7 is provided with a main pipe flow control element 6, and each of the collection branch pipes 12 is provided with a branch pipe flow control element 11. The uniformity of the flows of the waste heat recovery devices 9 is realized through differential arrangement of the flow control elements.

With the cooperation of the master pipe flow control element 17, the main pipe flow control elements 6 and the branch pipe flow control elements 11, the flow rates of the waste heat recovery devices 9 in the entire waste heat recovery and utilization system are uniform, and the flows and the pressure drops of the waste heat recovery devices 9 satisfy the following conditions:

$$q_1 = q_2 = q_3 = \ldots = q_i$$

$$\begin{cases} \dfrac{\Delta P_a}{\Delta P_t} \in [0.01, 0.1] \\ \dfrac{\Delta P_b}{\Delta P_t} \in [0.01, 0.1] \\ \dfrac{\Delta P_c}{\Delta P_t} \in [0.8, 0.98] \\ \Delta P_a + \Delta P_b + \Delta P_c = \Delta P_t \end{cases}$$

$$\Delta P_1 = \Delta P_2 = \ldots = \Delta P_n$$

where $q_i$ represents a flow rate of the working medium having waste heat flowing through the waste heat recovery devices 9 in group i, i=1, 2, 3 . . . n, and n represents the number of the groups of waste heat recovery devices 9. In order to ensure that the temperature rises of the air passing through the groups of waste heat recovery devices 9 are consistent, the flows of the working medium having waste heat flowing through the groups of waste heat recovery devices 9 are required to be consistent.

$\Delta P_t$ represents a total pressure drop of the entire waste heat recovery system, $\Delta P_a$ represents a total pressure drop of the collection master pipe 16, the return master pipe 5 and the master pipe flow control element 17 of the waste heat recovery system, $\Delta P_b$ represents a total pressure drop of the collection main pipes 7, the return main pipes 8 and the main pipe flow control elements 6 of the waste heat recovery system, and $\Delta P_c$ represents a sum of pressure drops of the waste heat recovery devices 9, the collection branch pipes 12, the return branch pipes 13 and the branch pipe flow control elements 11 of the waste heat recovery system.

$\Delta P_i$ represents a pressure drop of the working medium having waste heat passing through the waste heat recovery devices 9 in group i, and i=1, 2, 3 . . . n. $\Delta P_i$ is calculated by using the formula $\Delta P_i=\Delta P_{gi}+\Delta P_{ji}+\Delta P_{zi}$. In the formula, $\Delta P_{gi}$, represents a total pressure drop of a corresponding one of the collection main pipes 7 and a corresponding one of the return main pipes 8 corresponding to the waste heat recovery devices 9 in group i, $\Delta P_{ji}$ represents a total pressure drop of the waste heat recovery devices 9 in group i and corresponding ones of the branch pipe flow control elements 11 corresponding to the waste heat recovery devices 9 in group i, and $\Delta P_{zi}$ represents a total pressure drop of corresponding ones of the collection branch pipes 12 and corresponding ones of the return branch pipes 13 corresponding to the waste heat recovery devices 9 in group i. By adjusting the relationships between $\Delta P_{ji}$, $\Delta P_{zi}$ and $\Delta P_{gi}$ in each of the groups, $$\frac{\Delta P_1}{\Delta P_i} \to 1,$$

thereby ensuring that the temperature rises of the air of the groups of waste heat recovery devices 9 tend to be consistent.

Operating parameters of the master pipe flow control element 17, the main pipe flow control elements 6, or the branch pipe flow control elements 11 conform to the following relational formula:

$$q = \mu A\sqrt{2\Delta P\rho}$$

In the formula, q represents the flow rate, μ represents the flow coefficient, A represents the area of a flow control element, ΔP represents the pressure loss, and ρ represents the density of the waste heat source. The flow coefficient μ is determined by experimental data. $0.62 \le \mu \le 0.7$.

The flow control elements are arranged in groups based on distances between the waste heat recovery devices 9 and the waste heat source. The number of the waste heat recovery devices 9 in each of the groups is 8 to 10. The flows of the groups of waste heat recovery devices 9 are distributed through the arrangement of the flow control elements, to realize the consistency of the flow rate distribution of the waste heat recovery devices 9, thereby ensuring that the temperature field in the furnace chamber of the cracking furnace is evenly distributed and is not affected by the system of the present application. The temperature deviation of different groups of waste heat recovery devices 9 can be accurately controlled within ±3 celsius degrees.

The waste heat recovery system according to the present application implements the flow rate distribution method through the flow control elements, without adding an adjustment control valve. The flow rate in the system can be self-adaptively adjusted within a certain range in a case that the flow rate in the system changes. Simultaneously, the consistency of the flow rate distribution of the waste heat recovery devices 9 is realized, ensuring the uniformity of the temperature field in the cracking furnace.

In the waste heat recovery and utilization system according to the present application, the waste heat collection pipeline system and the waste heat return pipeline system are arranged according to the distribution priority of the waste heat source and form multiple leading-return pipelines. The leading-return pipelines operate independently and are switched for use. Two-stage leading-return pipelines are provided in the embodiment, and the waste heat source is a storage tank 1. Two-stage leading-return pipelines are implemented. The waste heat collection pipeline system of a first-stage leading-return pipeline is configured to lead out the heat source from the front of a first-stage heat exchanger 2, and the waste heat return pipeline system is configured to transport the heat source back to a first-stage return water point behind the first-stage heat exchanger 2. The waste heat collection pipeline system of a second-stage leading-return pipeline is configured to lead out the heat source between the first-stage heat exchanger 2 and the second stage-heat exchanger 3. The waste heat return pipeline system is configured to transport the heat source back to a second-stage return water point behind the second-stage heat exchanger 3. The two-stage leading-return pipelines operate independently and are switched for use according to requirements of the distribution priority of the heat source system, improving the flexibility and the adaptability of the waste heat recovery system.

In an embodiment, the waste heat recovery system further includes a desuperheating pressure-balance device. The desuperheating pressure-balance device includes: a pressure sensor 15, a temperature sensor 20, a regulating valve 19, desuperheating water 14, and a desuperheater 18. The pressure sensor 15 and the temperature sensor 20 are configured to monitor a temperature signal and a pressure signal of the waste heat collection master pipe 16. When the temperature signal and pressure signal exceed a set value, the regulating valve 19 is opened to allow the desuperheating water 14 to enter the desuperheater 18. The opening degree of the regulating valve 19 is proportional to a pressure difference signal of the pressure sensor 15. The desuperheater 18 is composed of nozzles arranged along the circumference of the collection master pipe 16. The desuperheating water 14 is mixed with the waste heat source through the nozzles to desuperheat the waste heat source. When the temperature signal and the pressure signal respectively monitored by the pressure sensor 15 and the temperature sensor 20 are lower than the set value, the regulating valve 19 is closed, and the desuperheating water 14 does not flow out.

The desuperheating pressure-balance device is configured to detect the pressure of the waste heat collection pipeline system, and solves the safety problem of water hammer in the pipeline network of the system due to large pressure fluctuations by desuperheating the waste heat source.

The waste heat recovery device 9 in the waste heat recovery system according to the present application preheats the combustion-supporting air of the bottom burner of the ethylene cracking furnace through the recovered waste heat, and to suck ambient cold air through the negative pressure margin of the furnace. Power equipment, such as blowers, induced draft fans, and pumps, is not required to be added to the system, thereby not increasing power consumption.

Figure 2:
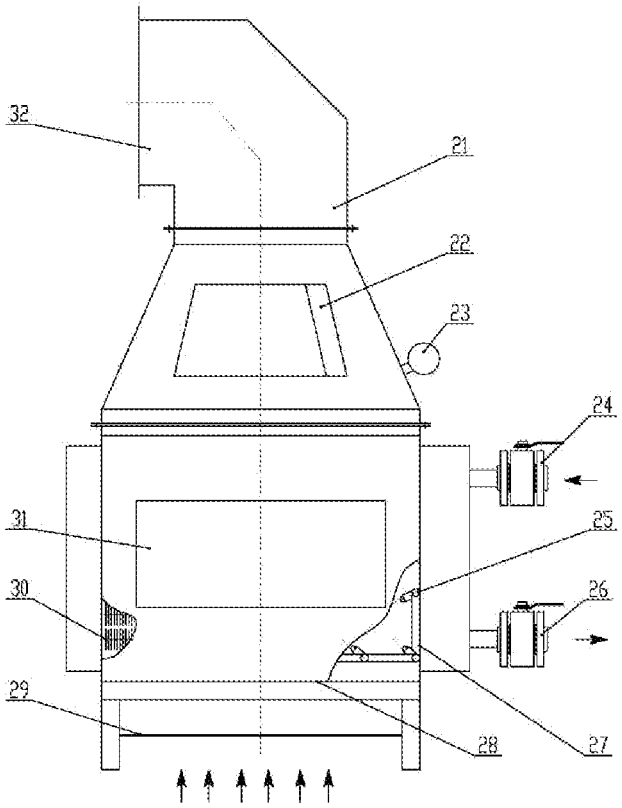
FIG. 2 is a schematic view of a waste heat recovery device according to the present application.

As shown in FIG. 2, each of the waste heat recovery devices 9 includes: a housing 27, an air inlet 28, an air outlet 32, a connection air duct 21, a water inlet assembly 24, a water outlet assembly 26, and a heat exchange element 28. The air inlet 28 and the air outlet 32 are arranged at two ends of the housing 27, and the water inlet assembly 24 and the water outlet assembly 26 are arranged on a side of the housing 27. The water inlet assembly 24 is connected to the waste heat collection pipeline system. The working medium having waste heat enters the waste heat recovery device 9 through the inlet assembly 24. Cold air enters the waste heat recovery device 9 through the air inlet 28, exchanges heat with the waste heat source through the heat exchange element 30 in the housing 27 and becomes hot air. An end of the connection air duct 21 is connected to the housing 27, and the other end is connected to the bottom burner of the ethylene cracking furnace through the air outlet 32. The preheated air enters the burner through the air outlet 32 for supporting combustion. The water outlet assembly 26 is connected to the waste heat return pipeline system to transport the working medium that has undergone the waste heat recovery and utilization.

Figure 3:
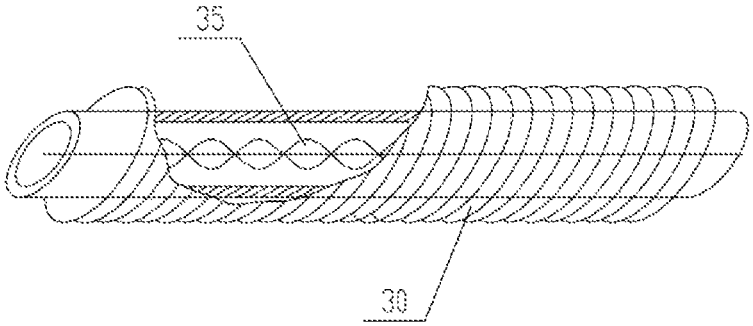
FIG. 3 is a schematic view of a heat exchange element and a spoiler assembly according to the present application.

As shown in FIG. 3, the heat exchange element 30 of the waste heat recovery device 9 in the embodiment is a finned tube bundle, and a spoiler element 35 is provided in the tube bundle to further enhance the heat exchange effect. The finned tube may be circular or elliptical.

In the embodiment, the air inlet 28 of the waste heat recovery device 9 is further provided with a dust-proof baffle 29, to reduce floating dust and impurities entering the equipment. An inspection door 31 is provided on a side of the housing 27 for overhauling the waste heat recovery device. The connection air duct 21 is provided with a thermometer 23 for monitoring the temperature of the preheated air. The connection air duct 21 is provided with a bypass damper 22 for supplementing spare air.

Figure 4:
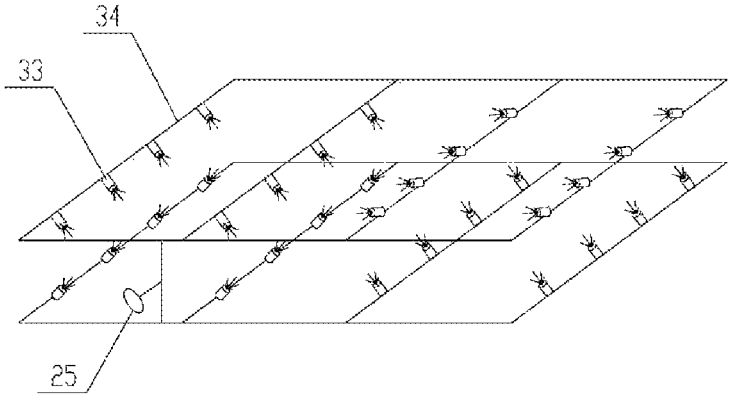
FIG. 4 is a schematic view of a self-cleaning device according to the present application.

In the embodiment, the waste heat recovery device 9 is further provided with a self-cleaning device 25. As shown in FIG. 4, the self-cleaning device 25 includes a blow pipeline 34 and multiple blow nozzles 33 arranged in two layers. Each of the blow nozzles 33 is a fan-shaped atomizing nozzle with a spraying angle ranging from 60 degrees to 120 degrees. The blow nozzles 33 are arranged opposite to each other in two layers in a vertical direction, and staggered with the heat exchange element 30. The blow medium is transported to the blow nozzles 33 through the blow pipeline 34 to blow the heat exchange element 30 on a wind ward side. The blow pipeline 34 and the blow nozzles 33 are connected through blow interfaces in a flange type. The blow medium is compressed air or low-pressure steam.

The present application has been described above in conjunction with the preferred embodiments, but the embodiments are only exemplary and illustrative. On this basis, various replacements and improvements may be made to the present application, and all fall within the protection scope of the present application.

The content not described in detail in the description of the present application pertains to well-known technologies for those skilled in the art.

The invention claimed is:

1. A zero-power-consumption self-adaptive distributed waste heat recovery and utilization system for an ethylene device, comprising:

a waste heat collection pipeline system, a plurality of waste heat recovery devices arranged in groups, and a waste heat return pipeline system, wherein the waste heat collection pipeline system is configured to lead out a working medium having waste heat from a waste heat source of the ethylene device and distribute the working medium to the plurality of waste heat recovery devices, the plurality of waste heat recovery devices are configured to heat combustion-supporting air of a bottom burner of an ethylene cracking furnace through the waste heat, and the waste heat return pipeline system is configured to transport the working medium that has undergone waste heat recovery and utilization back to the waste heat source; and the waste heat collection pipeline system is provided with flow control elements in stages, and flow rates in pipelines are distributed differentially through the flow control elements to allow flow rates in the groups of waste heat recovery devices to be distributed evenly;

the plurality of waste heat recovery devices are arranged in groups, each of the groups comprises at least two waste heat recovery devices, and the plurality of waste heat recovery devices are connected in parallel and operate independently;

the waste heat collection pipeline system comprises a collection master pipe, collection main pipes and collection branch pipes;

the waste heat return pipeline system comprises a return master pipe, return main pipes and return branch pipes;

the collection master pipe is configured to lead out the working medium having waste heat from the waste heat source, the working medium is transported to the groups of waste heat recovery devices through the collection main pipes, and is further transported to each of the waste heat recovery devices in a group through corresponding ones of the collection branch pipes;

the working medium that has undergone waste heat recovery and utilization by each of the waste heat recovery devices in the group is returned, through corresponding ones of the return branch pipes, to a corresponding one of the return main pipes corresponding to the waste heat recovery devices in the group, and further returned to the waste heat source through the return master pipe; and the collection master pipe is provided with a master pipe flow control element, each of the collection main pipes is provided with a main pipe flow control element, and each of the collection branch pipes is provided with a branch pipe flow control element.

2. The zero-power-consumption self-adaptive distributed waste heat recovery and utilization system for an ethylene device according to claim 1, wherein the flow rates in the groups of waste heat recovery devices are evenly distributed, and pressure drops of the waste heat recovery and utilization system satisfy the following conditions:

$$\begin{cases} \frac{\Delta P_a}{\Delta P_t} \in [0.01, 0.1] \\ \frac{\Delta P_b}{\Delta P_t} \in [0.01, 0.1] \\ \frac{\Delta P_c}{\Delta P_t} \in [0.8, 0.98] \\ \Delta P_a + \Delta P_b + \Delta P_c = \Delta P_t \end{cases}$$

$$\Delta P_{g1} + \Delta P_{j1} + \Delta P_{z1} = \Delta P_{g2} + \Delta P_{j2} + \Delta P_{z2} = \ldots = \Delta P_{gn} + \Delta P_{jn} + \Delta P_{zn}$$

wherein $\Delta P_t$ represents a total pressure drop of the waste heat recovery and utilization system, $\Delta P_a$ represents a total pressure drop of the collection master pipe, the return master pipe and the master pipe flow control element, $\Delta P_b$ represents a total pressure drop of the collection main pipes, the return main pipes and the main pipe flow control elements, and $\Delta P_c$ represents a total pressure drop of the waste heat recovery devices, the collection branch pipes, the return branch pipes and the branch pipe flow control elements; and n represents the number of the groups of waste heat recovery devices, $\Delta P_{gi}$ represents a total pressure drop of a corresponding one of the collection main pipes and a corresponding one of the return main pipes corresponding to the waste heat recovery devices in group i, $\Delta P_{ji}$ represents a total pressure drop of the waste heat recovery devices in group i and corresponding ones of the branch pipe flow control elements corresponding to the waste heat recovery devices in group i, and $\Delta P_{zi}$ represents a total pressure drop of corresponding ones of the collection branch pipes and corresponding ones of the return branch pipes corresponding to the waste heat recovery devices in group i, wherein i=1, 2, 3, . . . , n.

3. The zero-power-consumption self-adaptive distributed waste heat recovery and utilization system for an ethylene device according to claim 2, wherein operating parameters of the master pipe flow control element, the main pipe flow control elements, or the branch pipe flow control elements conform to the following relationship:

$$q = \mu A \sqrt{2\Delta P \rho}$$

wherein q represents the flow rate, μ represents the flow coefficient, A represents the area of a flow control element, ΔP represents the pressure loss, and ρ represents the density of the waste heat source.

4. The zero-power-consumption self-adaptive distributed waste heat recovery and utilization system for an ethylene device according to claim 3, wherein the number of the waste heat recovery devices in each of the groups is 8 to 10.

5. The zero-power-consumption self-adaptive distributed waste heat recovery and utilization system for an ethylene device according to claim 2, wherein the waste heat collection pipeline system is provided with a desuperheating pressure-balance device, and the desuperheating pressure-balance device comprises a pressure sensor, a temperature sensor, a regulating valve, desuperheating water and a desuperheater, wherein the pressure sensor and the temperature sensor are configured to monitor a temperature signal and a pressure signal of the waste heat collection pipeline system, the regulating valve is configured to perform opening degree adjustment based on the temperature signal and the pressure signal to control a flow rate of the desuperheating water, and the desuperheater is configured to spray the desuperheating water to cool the waste heat source and further maintain a stable pressure in the waste heat collection pipeline system.

6. The zero-power-consumption self-adaptive distributed waste heat recovery and utilization system for an ethylene device according to claim 2, wherein each of the waste heat recovery devices comprises an air inlet, an air outlet, a connection air duct, a water inlet assembly, a water outlet assembly and a heat exchange element, wherein the water inlet assembly is connected to the waste heat collection pipeline system for introducing the working medium having waste heat, the water outlet assembly is connected to the waste heat return pipeline system for returning the working medium that has undergone the waste heat recovery and utilization, the air inlet is configured to introduce cold air, the heat exchange element is configured to exchange heat between the working medium having waste heat and the cold air, and the air outlet is connected to the connection air duct for transporting preheated air.

7. The zero-power-consumption self-adaptive distributed waste heat recovery and utilization system for an ethylene device according to claim 6, wherein each of the waste heat recovery devices further comprises an online self-cleaning device, which comprises a blow pipeline and blow nozzles, each of the blow nozzles is a fan-shaped atomizing nozzle with a spraying angle ranging from 60 degrees to 120 degrees, and the blow nozzles are arranged opposite to each other in two layers;

a blow medium is transported to the blow nozzles through the blow pipeline to clean the waste heat recovery device; and the blow medium is compressed air or low-pressure steam.

8. The zero-power-consumption self-adaptive distributed waste heat recovery and utilization system for an ethylene device according to claim 6, wherein the heat exchange element is a circular or elliptical finned tube bundle.

9. The zero-power-consumption self-adaptive distributed waste heat recovery and utilization system for an ethylene device according to claim 8, wherein a spoiler assembly is provided in the finned tube bundle.

10. The zero-power-consumption self-adaptive distributed waste heat recovery and utilization system for an ethylene device according to claim 7, wherein the heat exchange element is a circular or elliptical finned tube bundle.

11. The zero-power-consumption self-adaptive distributed waste heat recovery and utilization system for an ethylene device according to claim 10, wherein a spoiler assembly is provided in the finned tube bundle.

* * * * *